US005140957A

United States Patent [19]

Walker

[11] Patent Number: 5,140,957

[45] Date of Patent: Aug. 25, 1992

[54] COMBINATION IN LINE AIR-FILTER/AIR-OIL SEPARATOR/AIR-SILENCER

[76] Inventor: Robert A. Walker, 17130 Roscoe Blvd., Northridge, Calif. 91325

[21] Appl. No.: 738,590

[22] Filed: Jul. 31, 1991

[51] Int. Cl.[5] ..... F02B 77/00

[52] U.S. Cl. ..... 123/198 E; 123/41.86; 55/DIG. 19; 55/DIG. 21

[58] Field of Search ..... 123/41.86, 198 E, 572; 181/229; 55/DIG. 19, DIG. 21, 461

[56] References Cited

U.S. PATENT DOCUMENTS

| | | | |
|---|---|---|---|
| 2,385,814 | 10/1945 | Kamrath | 181/229 |
| 3,277,876 | 10/1966 | Abts | 55/DIG. 19 |
| 3,614,859 | 10/1971 | Clark | 181/229 |
| 3,721,069 | 3/1973 | Walker | 55/319 |
| 3,789,582 | 2/1974 | Graybill | 55/92 |
| 4,184,858 | 1/1980 | Walker | 55/228 |
| 4,653,457 | 3/1987 | Stege | 55/DIG. 19 |
| 4,724,807 | 2/1988 | Walker | 55/461 |
| 4,861,359 | 8/1989 | Tettman | 123/41.86 |
| 4,947,806 | 8/1990 | Speer et al. | 123/41.86 |

OTHER PUBLICATIONS

Airsep "Walker Breathing System for Diesel Engines", Walker Engineering Company, 1 sheet (front and back sides).

Airsep "Walker Engine Breathing System for Automotive Diesels", (back side) Schematic Diagram of Engine Breathing System for Automotive Diesels, Walker Engineering Company.

"Oil/Air Separation: New Economies for Engines?, Airsep . . . and Engines Breathe Again", Apr., 1981.

*Primary Examiner*—Noah P. Kamen

*Attorney, Agent, or Firm*—Christie, Parker & Hale

[57] ABSTRACT

The combination apparatus silences and filters air flow and separates air-contaminant mixtures. An air filter joins an annular housing which has an outer wall and a channel defining a central axis, the channel having a primary gas inlet coupled to the air filter and a primary gas outlet and a channel wall. The apparatus has a secondary inlet port passing through the outer wall. A secondary outlet port defines an opening in the channel wall such that there is no straight line flow path between the secondary inlet and the secondary outlet. An air silencer is contained within the channel. A passageway between the secondary inlet and the secondary outlet is defined exteriorly by the outer wall and interiorly by the channel wall.

48 Claims, 5 Drawing Sheets

78
33
84
80
85
86
76
100
20
74
88
82
83
72
82
68
70

COMBINATION IN LINE AIR-FILTER/AIR-OIL SEPARATOR/AIR-SILENCER

BACKGROUND OF THE INVENTION

1. Field of the Invention

The present invention relates generally to air-oil separators, more specifically to a closed system which silences and filters air in a flow line input to an engine, separates oil out of the contaminated engine atmosphere and regulates the pressure of the engine atmosphere.

2. Related Art

Prior U.S. Pat. Nos. 3,721,069, 4,184,858 and 4,724,807 relate to air-oil separators. The specifications and claims of these patents are incorporated herein by reference. In the '069 patent, the separator uses a baffle for producing primary separation of oil from the air-oil mixture and causes the mixture to be driven through filtration material. The oil separated from the mixture then drops to a reservoir for return back to the engine crankcase, oil pump, etc. The outlet conduit has a greater cross sectional area relative to the inlet port to provide a means whereby the pressure of the mixture or vapor introduced into the device can be reduced to near atmospheric pressure, contributing significantly to the action of the device.

In the '858 patent, which is an adaptation of the '069 patent, the filtering material is coated with a fluid to assist in removal of the oil from the air-oil mixture. The filtered air output of either separator may be passed to the clean air intake of the engine.

SUMMARY OF THE INVENTION

The present invention is an improvement of the system described in U.S. Pat. No. 4,274,807. The present invention comprises a combined air-filter/air-oil separator/air-silencer and a vacuum limiter.

The invention provides a closed system with no moving parts for regulating/cleansing the environment of an internal combustion engine. The invention includes an annular air filter joined to an annular housing having an outer wall and a channel in the housing defining a central axis. The channel has a primary gas inlet and a primary gas outlet and a channel wall. The end of the channel coupled to the air filter is the primary gas inlet and the opposite end of the channel is the primary gas outlet. The annular housing has a secondary inlet port through the outer wall and a secondary outlet port defining an opening in the channel wall.

A silencer such as an annular sheet of perforated aluminum or other similar material is received within the channel wall, spaced away from the inner side of the channel wall, and also oriented on the central axis. Sound deadening material fills the space between the annular sheet of material and the inner side of the channel wall. A section of the perforated material and sound deadening material is cut away so as not to cover the secondary outlet in the channel wall.

The secondary outlet in the channel wall is formed in the wall such that there is no straight line flow path between the secondary inlet and the secondary outlet. A passageway between the secondary inlet and the secondary outlet is defined exteriorly by the inside surface of the outer wall and interiorly by the outside surface of the channel wall. The passageway may include one or more baffles for forming condensation/precipitation or adsorption surfaces for removing the oil from the air-contaminant mixture. When there is only one baffle, the secondary inlet and the secondary outlet are oriented on a side of the apparatus opposite the side of the apparatus where an opening in the baffle occurs.

In one form, the invention is placed so that the channel is in-line with the air intake and the induction system for heavy engines. The filter end of the invention is coupled to the air intake line and the primary outlet is coupled to the induction system. The secondary inlet is coupled with a vacuum limiter to the engine breather for the crankcase. An oil drain plug is provided in the annular housing for returning the filtered oil to the engine block. A check valve is coupled between the oil drain plug and the engine to prevent oil backflow due to existence of a higher vacuum in the separator than in the engine crankcase.

DETAILED DESCRIPTION OF THE PREFERRED EMBODIMENTS

Figure 1:
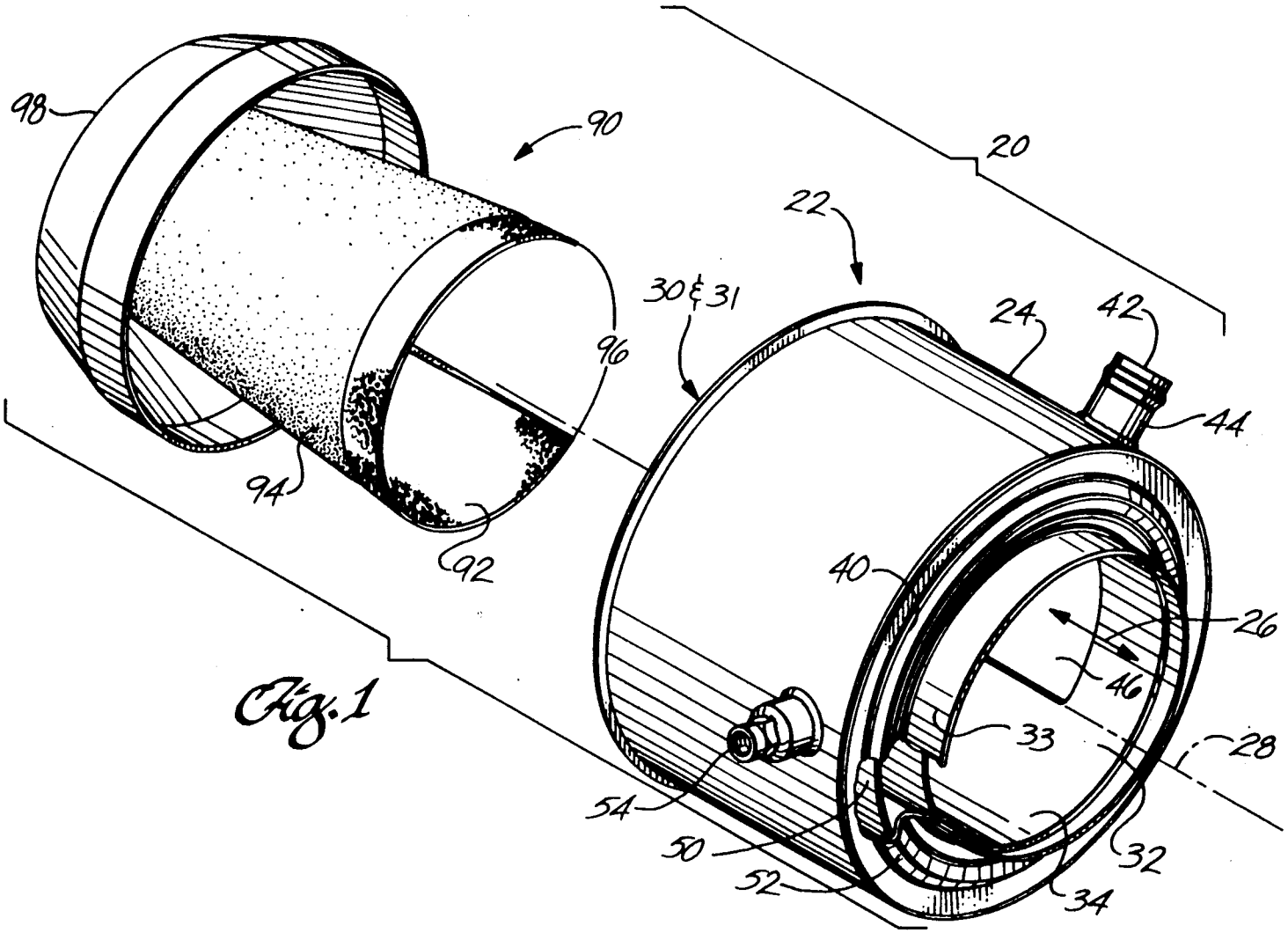
FIG. 1 shows an exploded perspective and partial cutaway schematic of a combination apparatus.

FIG. 1 shows a combination apparatus 20 for silencing and filtering intake air and separating contaminants (including oil and other heavy hydrocarbons) from pressurized air-contaminant mixtures. Only the silencer and separator aspects of the apparatus are shown. The apparatus is formed from an annular housing 22 having an outer wall 24. The outer wall may be formed from aluminum, sheet metal or other material suitable for withstanding the temperature and environment associated with internal combustion engines.

A channel 26 forms the central portion of the annular housing and defines an axis 28 about which the housing is substantially symmetrical. The channel has a primary gas inlet 30 (not shown). The primary gas inlet is joined to an annular air-filter 100 (not shown in FIG. 1, see FIG. 3) which is also substantially symmetrical about axis 28. The channel also has, at the opposite end from the primary gas inlet, a primary gas outlet 32, typically coupled to an air induction system for an engine. The channel has a channel wall 34 preferably formed from the same material from which the outer wall 24 was formed. The channel wall extends along axis 28 a distance greater than the length of the outer wall 24 forming an inlet flange 31 (not shown) and an outlet flange 33 for coupling to respective hoses or ducts for conducting the primary air flow and for allowing continuous flow between the hoses or ducts and the channel 26. The inlet flange 31 is substantially the same as outlet flange 33, but faces in the opposite direction relative to the outlet flange. Air flows through the channel from the inlet flange to the outlet flange.

The outer wall and the channel are maintained in spaced apart relation with respect to each other through a pair of convoluted end surfaces 40. Only the convoluted end surface on the outlet flange end of the apparatus is shown in the drawings. Both convoluted end surfaces are riveted or otherwise fastened to the channel walls at each flange. The convoluted end surfaces are attached in a manner such as that described in U.S. Pat. No. 4,724,807 to form an airtight, except as described below, hollow enclosure 22.

A secondary inlet port 42 extends through the outer wall 24 by means of 44 which is preferably riveted or spot welded to the outer wall. The secondary inlet port provides a gas flow path for air-oil mixtures into the interior of the annular housing. The secondary inlet is adapted to be coupled to a breather connection of an internal combustion engine as described more fully below. The annular housing further includes a secondary outlet port 46 opening in the channel wall 34.

An air-silencer 90 is contained within the channel wall 34. Spaced away from the inside surface of the channel wall 34, and also oriented on the central axis, is an annular or conical tube 92 of perforated aluminum or other similar material. Sound deadening material 94 fills the space between the annular piece of perforated material 92 and the inner side of the channel wall 34. A section 96 of both the perforated material and sound deadening material is cut away so as not to cover the secondary outlet 46 in the channel wall.

An annular cap 98 is welded or similarly attached to the ring formed by the primary gas inlet end of the annular perforated material 92. When the air-silencer 90 is installed in the channel 26, cap 98 fits neatly over the primary gas inlet flange 31 of the channel, preventing interruption of the fluid air flow over the primary gas inlet flange into the channel.

The beneficial noise reduction realized from the addition of the air-silencer has been measured to be in the range of 8.5 dB at a channel air flow rate of 1400 cubic feet per minute (noise level reduced from 122.0 dB to 113.5 dB). The combination apparatus may be constructed with or without the air-silencer installed with no effect on the overall operation of the apparatus.

The secondary outlet 46 is formed in the housing in such a way that there is no straight line flow path between the secondary inlet and the secondary outlet. The interior of the housing defines a passageway for fluid flow between the secondary inlet and the secondary outlet. The passageway is defined at the outermost extreme by the inside surface of the outer wall 24 and at the innermost extreme by the inside surface of the channel wall 34. As will be discussed more fully below, a first baffle 50 is positioned in the housing between the outer wall and the channel wall and spaced from each. Both edges of the first baffle extend into respective convolutions 52 in the convoluted end surfaces 40. As shown in FIG. 1, the first baffle 50 contacts in the convoluted end a first convolution 52 formed as a ridge extending away from the interior of the housing. The edge of the baffle contacts the inside vertex formed by the ridge. In the preferred embodiment, the edges of the first baffle are sealed in the vertex with a silicone or epoxy sealer for preventing passage of the crankcase air between the baffle and the convoluted surface. The outer wall, the baffle and the channel wall are preferably concentric.

A drain coupling 54 is preferably centrally mounted between the edges of the outer wall 24 to allow oil to drain from the interior of the annular housing. A hose or other similar conduit may be attached to the coupling for feeding the oil to an engine block. A check valve is preferably coupled in a conventional manner between the hose and the engine block, to prevent backflow of oil from the crankcase to the interior of the annular housing. The valve is necessary because the vacuum level in the crankcase may be lower than vacuum level in the housing. The circumferential location of the drain coupling with respect to the secondary inlet 42 will be determined by the final orientation of the housing with respect to the engine. Once the final orientation is determined, the drain coupling is mounted to the outer wall at the bottom of the housing so that the oil enters the coupling through force of gravity. However, for any given engine design, the position of the coupling will be the same.

In the remaining FIGURES, identical elements are identically numbered and have the same structure and function as described above. Additional elements will now be described.

Figure 2:
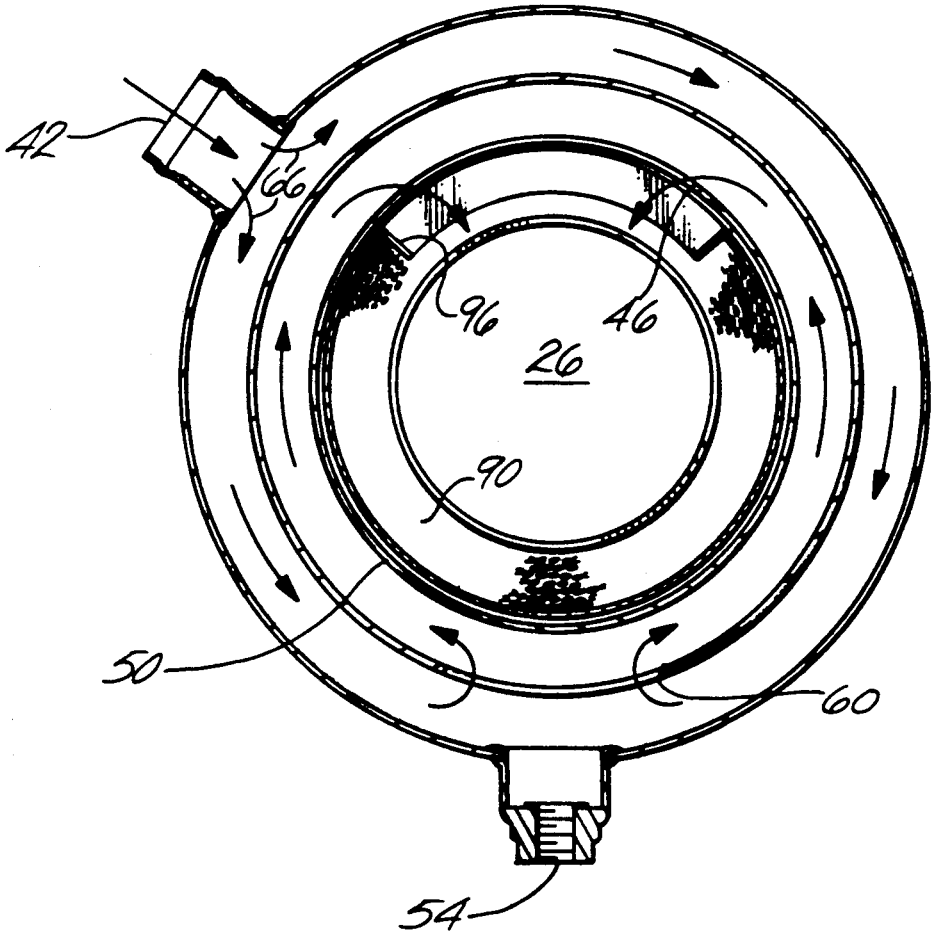
FIG. 2 is a vertical cross-section schematic of the apparatus of FIG. 1.

FIG. 2 shows a cross section of the single baffle apparatus of FIG. 1, including the air silencer 90 installed in the channel. The secondary inlet 42 is oriented near the physical top of the apparatus. The drain 54 is located at the bottom of the apparatus. The single baffle 50 fits into a single convolution on the respective convoluted end surfaces 40. In the embodiment shown in FIG. 2 the first baffle opening 60 is located on a side of the housing substantially opposite that of the secondary inlet 42 and the secondary outlet 46. The flow between the secondary inlet 42 and the secondary outlet 46 is indicated by the arrows 66 in FIG. 2. As can be seen, the baffle 50 defines passageways along which the air-contaminant mixture must pass before reaching the secondary outlet 46. Filter material may be used in the passageways but is not necessary.

In the preferred embodiment, the secondary inlet 42 has a diameter of one and one-quarter inches. The secondary outlet 46 is in the shape of a rectangle with slightly rounded corners, and has an arcuate opening distance of 3.5 inches and an axial opening distance of 3.5 inches. The inside diameter of the channel is preferably six inches, the diameter of the first baffle seven inches and the diameter of the outer wall 24 eight and one-half inches. The length of the flange 33 (FIG. 1) is preferably one and one-eighth inches, the distance between the flange 33 and the convolution 52 is one inch. As one alternative the outer wall diameter could be seven and one-half inches with a smaller opening; the secondary inlet could be one inch in diameter.

Figure 3:
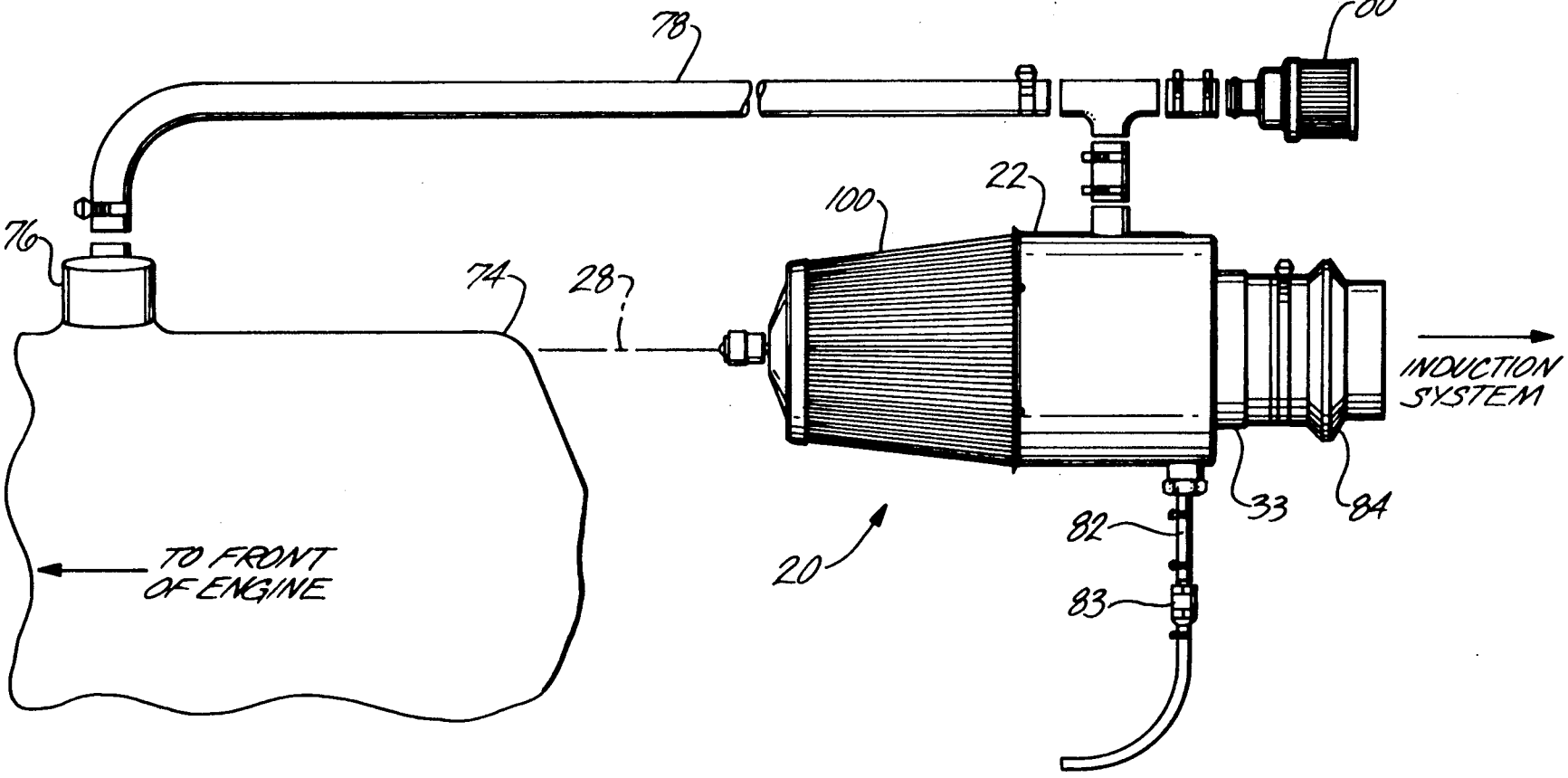
FIG. 3 shows a side elevation schematic of hose connections for the combination apparatus of the present invention.

FIG. 3 shows the system of the present invention connected to an internal combustion engine having an induction system, engine block 74 and an engine breather 76. The engine breather 76 is coupled through a hose 78 with a vacuum limiter 80 to the combination apparatus 20. The annular air-filter 100 and annular housing 22 are clearly visible. Air-silencer 90 and air-silencer cap 98 are not visible in FIG. 3 because they are contained within the channel formed by the annular air filter and annular housing and are thus hidden from view. A fluid line 82 extends from the drain coupling 50 on the bottom of the annular housing through a check valve 83 to the engine's oil reservoir. Check valve 83 prevents oil from being sucked up out of the oil reservoir into the combination apparatus. The primary gas outlet flange 33 of the combination apparatus 20 is coupled to a hose 84 running to the engine's intake air turbo. Alternatively, engines without turbos have the primary gas outlet of the combination apparatus coupled to the induction system for the engine. Generally, the filtering apparatus can be adapted to the crankcase and clean air intake systems of any internal combustion engine.

Figure 4:
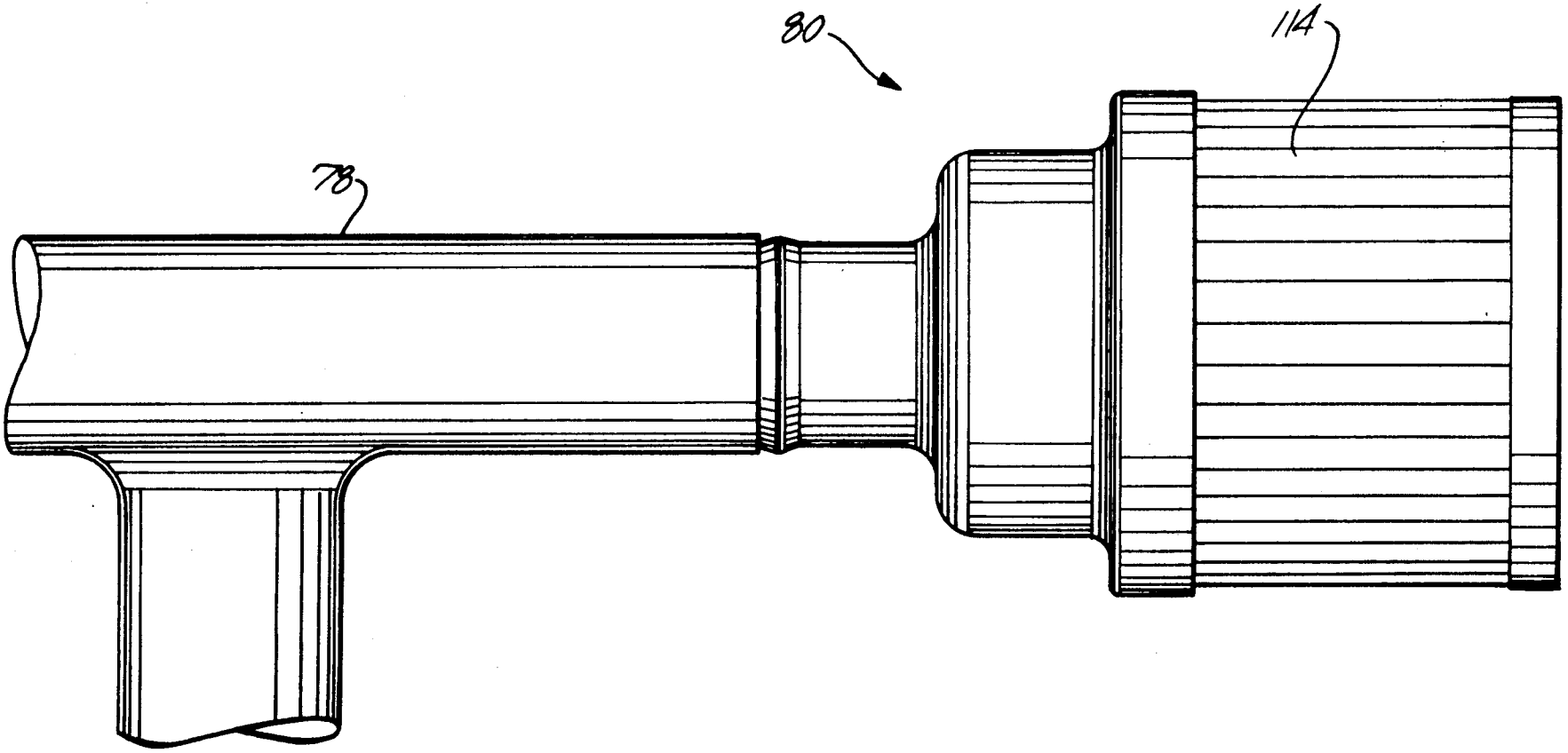
FIG. 4 is a schematic side-sectional view of a vacuum limiter used between the engine breathers of the engine shown in FIG. 3 and the input of the filtering apparatus.

FIG. 4 shows a detail of the hose 78 and vacuum limiter 80. The vacuum limiter is coupled to a portion of the hose, through a hose and clamp. The vacuum limiter includes a valve (not shown) to close off an air tube open to the ambient air through an air filter 114. The air filter 114 is a conventional automotive-type air cleaner manufactured by K&N Engineering Inc., Riverside, Calif. to be fitted to and joined with the vacuum limiter. The combination apparatus 20 is preferably oriented so that the axis 28 is oriented on the center line of a turbo charger for engines which are equipped with such devices.

Figure 5:
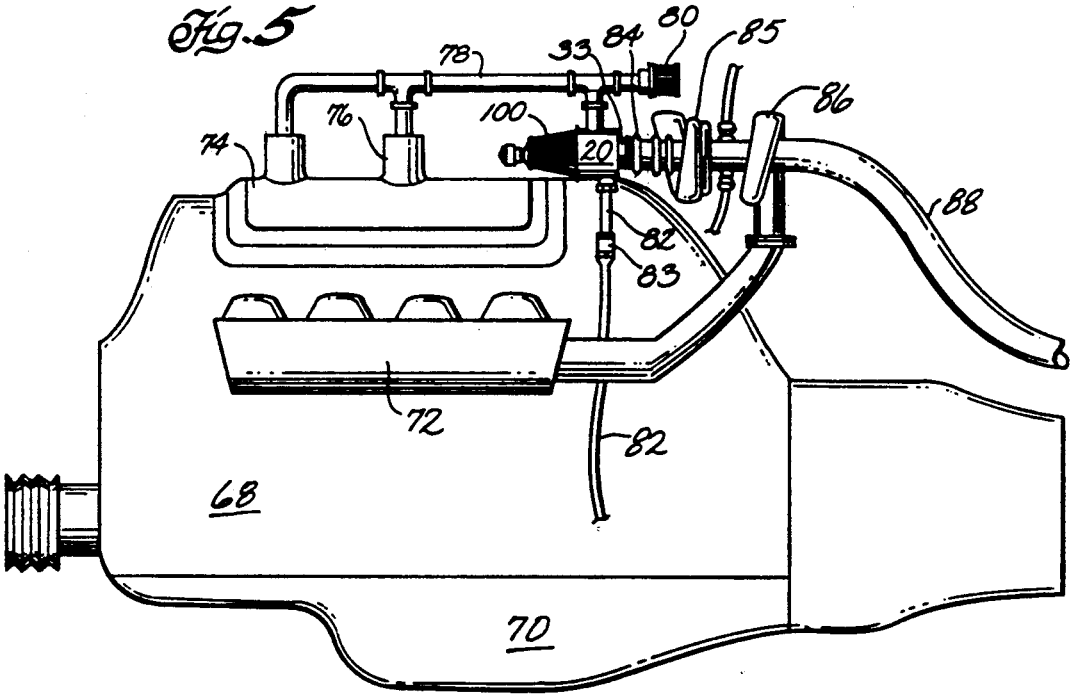
FIG. 5 is a schematic side elevation view of an engine incorporating the filtering apparatus of FIG. 1.

FIG. 5 shows the combination apparatus 20 mounted on an engine block 68 including an oil reservoir 70, an exhaust manifold 72, and a valve cover 74. The engine breather 76 is coupled through a hose 78 with a vacuum limiter 80 to the combination apparatus 20. Oil from the drain coupling on the combination apparatus passes through an oil line 82 to the oil reservoir via a check valve 83. The outlet of the combination apparatus is coupled to an intake air turbo 85 through a hose 84. The exhaust manifold 72 is coupled to an exhaust turbo 86, which in turn is coupled to the exhaust 88. Alternatively, engines without turbos have the primary outlet of the filtering apparatus coupled to the induction system for the engine. Generally, the filtering apparatus can be adapted to the crankcase and clean air intake systems of any internal combustion engine.

By referencing FIGS. 1-3, consider now the operation of the combination apparatus. With the connections formed as shown in FIGS. 3 and 5, the intake air turbo creates a vacuum for pulling air into the combination apparatus. (The same effect is produced without a turbo when the primary gas outlet 32 of the filtering apparatus is coupled to the induction system of the engine.) The air is pulled through the air filter 100, past silencer 90 and into the channel 26. The pulling effect of the turbo on the air in the channel produces a pressure differential between the secondary outlet 46 and the secondary gas inlet 42 forcing contaminated air to flow out from the engine breather 76 through the hose 78 past the vacuum limiter 80. The pressure differential between the secondary inlet 42 and the secondary outlet 46 is assisted by the difference in cross-sectional area of the breather port 76 and the secondary outlet 46. The ratio of the cross-sectional area of the breather port to the cross-sectional area of the secondary outlet may be about 12%, but may have a range of values depending on the type of engine, etc. The values may range from 8% to 25% but no outside limit for the range has been defined.

The contaminated air evacuated from the engine breather is introduced into the primary gas inlet 42 so that the air strikes the first baffle 50. The oil-contaminated air passes through the passageways in the annular housing 22 along the flow lines indicated by the arrows 66 (FIG. 2). The oil in the contaminated air impacts and condenses or is adsorbed on the interior surface of the outer wall and the exterior surface of the first baffle 50. This process continues as the contaminated air flows about the first baffle until the engine air, now decontaminated, exits the secondary outlet and enters the channel and merges with the just filtered intake air. The merged air then continues along the channel 26 to the intake air turbo, which then transports the air to the engine as usual.

Alternatively, all the pressure drop between the engine breather and the secondary outlet may occur within the annular housing by making the diameter of the secondary inlet the same as the diameter of the breather port. Then the range of cross sectional areas are maintained or adjusted by considering the diameter of secondary outlet rather than that of the breather port.

The combination apparatus may be designed for any type of engine, as long as the ratio of breather port to secondary outlet area is maintained in the desired range for a given efficiency or throughput. The efficiency of the combination apparatus may be changed by varying the diameter of the apparatus, i.e. increasing the surface area of the baffles and interior surfaces in the housing and increasing the cross-sectional area of the flow path, or increasing the axial length of the annular housing, with the same result. The throughput may be changed by changing the breather port or the secondary inlet and outlet cross-sectional areas.

Attachment of the combination apparatus to an engine creates a slight vacuum in the crankcase. The presence of oil droplets or particles in the crankcase atmosphere is due partly to the relatively high pressure in the crankcase. By attaching the combination apparatus to an engine, the pressure in the crankcase is eliminated and an actual slight vacuum replaces the high pressure crankcase atmosphere. This serves to significantly decrease the amount of oil, contaminants and blowby byproducts entrained in the crankcase air, and may reduce oil consumption by up to as much as 50%. It is significant that the vacuum created in the crankcase not be too large. Otherwise, a relatively large amount of oil and oil laden air will be pulled from the crankcase. For example, if the air-filter 100 becomes clogged for any reason, the suction created by the turbo or the induction system would increase the pressure differential between the breather and the combination apparatus. The vacuum limiter 80 described below prevents the occurrence of too large of a pressure differential.

The vacuum limiter limits the vacuum maintained in the crankcase. If the vacuum developed in hose 78 increases beyond a given point outside air is pulled in from the air tube 94 into the hose 78. This prevents evacuation of more oil and contaminated air from the crankcase than is desirable. In the presently preferred embodiment, the limiter is set to maintain vacuum with crankcase up to 6 inches of water vacuum. Beyond that point, the limiter opens and air is admitted to the crankcase. Depending on operational conditions, other threshold values can also be chosen. Operation in this manner provides a closed crankcase ventilation system which complies with current requirements of the Clean Air Act.

The cross-sectional area of the passageways in the interior of the filtering apparatus is preferably greater than or approximately equal to the cross-sectional area of the secondary outlet. This maintains a low flow velocity to the passageways.

The in-line arrangement of the filtering apparatus provides for a pressure differential between the breather and the channel 26 for transferring the contaminated air from the breather. The design requires little modification of the air intake design of current engines and is simple and economical to assemble. Significantly, the in-line design with the filtered air being supplied to the induction system and the oil being returned to the oil system produces a closed crankcase ventilation system. The system conserves oil, returns lighter unburned hydrocarbons to the induction system, creates a slight crankcase vacuum, increases fuel efficiency and prolongs engine lifetime.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention. For example, there may be cases where zero, three or four baffles are appropriate.

What is claimed is:

1. A combination apparatus for silencing and filtering air flow and separating air-contaminant mixtures, the apparatus comprising:

an air filter joined to an annular housing having an outer wall;

a channel in the housing defining a central axis, having on one end of the channel a primary gas inlet coupled to the air filter, and having on the opposite end of the channel a primary gas outlet, and having a channel wall, the channel wall having inside and outside surfaces;

a secondary inlet port through the outer wall;

a secondary outlet port defining an opening in the channel wall such that there is no straight line flow path between the secondary inlet and the secondary outlet;

an air silencer contained within the channel; and a passageway between the secondary inlet and the secondary outlet defined exteriorly by the outer wall and interiorly by the channel wall.

2. The apparatus as claimed in claim 1 wherein the air silencer comprises an annular sheet of perforated material contained within the channel, spaced away from the inside surface of the channel wall and oriented on the central axis, having sound deadening material filling the space between the annular sheet of perforated material and the inside surface of the channel wall, and having a section of the perforated material and sound deadening material cut away so as not to cover the secondary outlet in the channel wall.

3. The apparatus as claimed in claim 1 further comprising a baffle between the outer wall and the channel wall.

4. The apparatus as claimed in claim 3 wherein the baffle comprises an opening on a side of the housing substantially opposite the secondary inlet for passage of air toward the secondary outlet.

5. The apparatus as claimed in claim 4 wherein the secondary outlet port is positioned in the channel wall on a side of the housing substantially the same as the secondary inlet.

6. The apparatus as claimed in claim 1 wherein the primary gas outlet is adapted to be coupled to an engine induction system.

7. The apparatus as claimed in claim 1 wherein the secondary inlet is adapted to be coupled to an engine crankcase breather.

8. The apparatus as claimed in claim 1 further comprising a vacuum limiter in a flow line coupled to the secondary inlet for limiting a vacuum in the flow line.

9. The apparatus as claimed in claim 8 wherein the vacuum limiter comprises a one-way valve, wherein the valve is drawn open by an increase in the vacuum in the flow line past a certain tolerance level.

10. The apparatus as claimed in claim 1 further comprising a drain coupled to the housing for eliminating a contaminant from the housing.

11. The apparatus claimed in claim 10 wherein the drain and the primary gas outlet comprise the only outlet for flow from the secondary inlet.

12. The apparatus as claimed in claim 11 further comprising a return line connected to the drain, the return line comprising a check valve whereby contaminant only flows one-way through the line, in a direction away from the housing; and wherein the combination apparatus, the induction system and the return line comprise a closed crankcase ventilation system.

13. The apparatus as claimed in claim 1 wherein the secondary inlet and the secondary outlet each comprise respective cross sectional areas and wherein the cross sectional area of the secondary inlet is less than the cross sectional area of the secondary outlet.

14. The apparatus as claimed in claim 13 wherein the ratio of the cross sectional area of the secondary inlet to the cross sectional area of the secondary outlet is approximately 0.15.

15. A combination apparatus for silencing and filtering air flow and separating air-contaminate mixtures, the apparatus comprising:

an air filter joined to an annular housing having an outer wall;

a channel in the housing defining a central axis, having on one end of the channel a primary gas inlet coupled to the air filter, and having on the opposite end of the channel a primary gas outlet, and having a channel wall, the channel wall having inside and outside surfaces;

a secondary inlet port through the outer wall;

a secondary outlet port defining an opening in the channel wall such that there is no straight line flow path between the secondary inlet and the secondary outlet; and a passageway between the secondary inlet and the secondary outlet defined exteriorly by the outer wall and interiorly by the channel wall;

further comprising a baffle between the outer wall and the channel wall, wherein the baffle comprises an opening on a side of the housing substantially opposite the secondary inlet for passage of air toward the secondary outlet, wherein the secondary outlet port is positioned in the channel wall on a side of the housing substantially the same as the secondary inlet.

16. The apparatus as claimed in claim 15 wherein the primary gas outlet is adapted to be coupled to an induction system.

17. The apparatus as claimed in claim 15 wherein the secondary inlet is adapted to be coupled to an engine crankcase breather.

18. The apparatus as claimed in claim 15 further comprising a vacuum limiter in a flow line coupled to the secondary inlet for limiting a vacuum in the flow line.

19. The apparatus as claimed in claim 18 wherein the vacuum limiter comprises a one-way valve, wherein the valve is drawn open by an increase in the vacuum in the flow line past a certain tolerance level.

20. The apparatus as claimed in claim 15 further comprising a drain coupled to the housing for eliminating a contaminant from the housing.

21. The apparatus claimed in claim 20 wherein the drain and the primary gas outlet comprise the only outlet for flow from the secondary inlet.

22. The apparatus as claimed in claim 21 further comprising a return line connected to the drain, the return line comprising a check valve whereby contaminant only flows one-way through the line, in a direction away from the housing.

23. The apparatus as claimed in claim 15 wherein the secondary inlet and the secondary outlet each comprise respective cross sectional areas and wherein the cross sectional area of the secondary inlet is less than the cross sectional area of the secondary outlet.

24. A combination apparatus for silencing and filtering air flow and separating air-contaminate mixtures, the apparatus comprising:

an air filter joined to an annular housing having an outer wall;

a channel in the housing defining a central axis, having on one end of the channel a primary gas inlet coupled to the air filter, and having on the opposite end of the channel a primary gas outlet, and having a channel wall, the channel wall having inside and outside surfaces;

a secondary inlet port through the outer wall;

a secondary outlet port defining an opening in the channel wall such that there is no straight line flow path between the secondary inlet and the secondary outlet; and a passageway between the secondary inlet and the secondary outlet defined exteriorly by the outer wall and interiorly by the channel wall;

wherein the secondary inlet and the secondary outlet of the apparatus each comprise respective cross sectional areas and wherein the cross sectional area of the secondary inlet is less than the cross sectional area of the secondary outlet;

wherein the breather outlet comprises a cross sectional area and a ratio of the cross sectional area of the breather outlet to the cross sectional area of the secondary outlet is approximately 0.15.

25. An improved internal combustion engine having an induction system and an engine block with an engine breather, the improvement comprising:

a combination apparatus for silencing and filtering air flow and separating air-contaminant mixtures, the apparatus comprising:

an air filter joined to an annular housing having an outer wall;

a channel in the housing defining a central axis, having on one end of the channel a primary gas inlet coupled to the air filter, and having on the opposite end of the channel a primary gas outlet, and having a channel wall, the channel wall having inside and outside surfaces;

a secondary inlet port through the outer wall;

a secondary outlet port defining an opening in the channel wall such that there is no straight line flow path between the secondary inlet and the secondary outlet;

an air silencer contained within the channel; and a passageway between the secondary inlet and the secondary outlet defined exteriorly by the outer wall and interiorly by the channel wall.

26. The engine as claimed in claim 25 wherein the air silencer of the apparatus comprises an annular sheet of perforated material contained within the channel, spaced away from the inside surface of the channel wall and oriented on the central axis, having sound deadening material filling the space between the annular sheet of perforated material and the inside surface of the channel wall, and having a section of the perforated material and sound deadening material cut away so as not to cover the secondary outlet in the channel wall.

27. The engine as claimed in claim 25 wherein the apparatus further comprises a baffle between the outer wall and the channel wall.

28. The engine as claimed in claim 27 wherein the baffle of the apparatus comprises an opening on a side of the housing substantially opposite the secondary inlet for passage of air toward the secondary outlet.

29. The engine as claimed in claim 28 wherein the secondary outlet port of the apparatus is positioned in the channel wall on a side of the housing substantially the same as the secondary inlet.

30. The engine as claimed in claim 25 wherein the primary gas outlet of the apparatus is coupled to the engine induction system.

31. The engine as claimed in claim 25 wherein the secondary inlet of the apparatus is coupled to the engine breather.

32. The engine as claimed in claim 25 further comprising a vacuum limiter coupled between the engine breather and the secondary inlet for limiting a vacuum in a flow line between the breather and the secondary inlet.

33. The engine as claimed in claim 32 wherein the vacuum limiter comprises a one-way valve, wherein the valve is drawn open by an increase in the vacuum in the flow line past a certain tolerance level.

34. The engine as claimed in claim 25 wherein the apparatus further comprises a drain coupled to the housing for eliminating a contaminant from the housing.

35. The engine as claimed in claim 34 wherein the drain and the primary gas outlet of the apparatus comprise the only outlet for flow from the engine breather.

36. The engine as claimed in claim 35 wherein the apparatus further comprises a return line connected between the drain and the engine block, the return line comprising a check valve whereby contaminant only flows one-way through the line, in a direction away from the housing and whereby the combination apparatus, the induction system and the return line comprise a closed crankcase ventilation system.

37. The engine as claimed in claim 25 wherein the secondary inlet and the secondary outlet of the apparatus each comprise respective cross sectional areas and wherein the cross sectional area of the secondary inlet is less than the cross sectional area of the secondary outlet.

38. The engine as claimed in claim 37 wherein the breather outlet comprises a cross sectional area and a ratio of the cross sectional area of the breather outlet to the cross sectional area of the secondary outlet is approximately 0.15.

39. An improved internal combustion engine having an induction system, and an engine block with an engine breather, the improvement comprising:

a combination apparatus for silencing and filtering air flow and separating air-contaminate mixtures, the apparatus comprising:

an air filter joined to an annular housing having an outer wall;

a channel in the housing defining a central axis, having on one end of the channel a primary gas inlet coupled to the air filter, and having on the opposite end of the channel a primary gas outlet, and having a channel wall, the channel wall having inside and outside surfaces;

a secondary inlet port through the outer wall;

a secondary outlet port defining an opening in the channel wall such that there is no straight line flow path between the secondary inlet and the secondary outlet; and a passageway between the secondary inlet and the secondary outlet defined exteriorly by the outer wall and interiorly by the channel wall;

wherein the apparatus further comprises a baffle between the outer wall and the channel wall;

wherein the baffle of the apparatus comprises an opening on a side of the housing substantially opposite the secondary inlet for passage of air toward the secondary outlet;

wherein the secondary outlet port of the apparatus is positioned in the channel wall on a side of the housing substantially the same as the secondary inlet.

40. The engine as claimed in claim 39 wherein the primary gas outlet of the apparatus is coupled to the engine induction system.

41. The engine as claimed in claim 39 wherein the secondary inlet of the apparatus is coupled to the engine breather.

42. The engine as claimed in claim 39 further comprising a vacuum limiter coupled between the engine breather and the secondary inlet for limiting a vacuum in a flow line between the breather and the secondary inlet.

43. The engine as claimed in claim 42 wherein the vacuum limiter comprises a one-way valve, wherein the valve is drawn open by an increase in the vacuum in the flow line past a certain tolerance level.

44. The engine as claimed in claim 39 wherein the apparatus further comprises a drain coupled to the housing for eliminating a contaminant from the housing.

45. The engine as claimed in claim 44 wherein the drain and the primary gas outlet of the apparatus comprise the only outlet for flow from the engine breather.

46. The engine as claimed in claim 45 wherein the apparatus further comprises a return line connected between the drain and the engine block, the return line comprising a check valve whereby contaminant only flows one-way through the line, in a direction away from the housing and whereby the combination apparatus, the induction system and the return line comprise a closed crankcase ventilation system.

47. The engine as claimed in 39 wherein the secondary inlet and the secondary outlet of the apparatus each comprise respective cross sectional areas and wherein the cross sectional area of the secondary inlet is less than the cross sectional area of the secondary outlet.

48. An improved internal combustion engine having an induction system, and an engine bock with an engine breather, the improvement comprising:

a combination apparatus for silencing and filtering air flow and separating air-contaminate mixtures, the apparatus comprising:

an air filter joined to an annular housing having an outer wall;

a channel in the housing defining a central axis, having on one end of the channel a primary gas inlet coupled to the air filter, and having on the opposite end of the channel a primary gas outlet, and having a channel wall, the channel wall having inside and outside surfaces;

a secondary inlet port through the outer wall;

a secondary outlet port defining an opening in the channel wall such that there is no straight line flow path between the secondary inlet and the secondary outlet; and a passageway between the secondary inlet and the secondary outlet defined exteriorly by the outer wall and interiorly by the channel wall;

wherein the secondary inlet and the secondary outlet of the apparatus each comprise respective cross sectional areas and wherein the cross sectional area of the secondary inlet is less than the cross sectional area of the secondary outlet;

wherein the breather outlet comprises a cross sectional area and a ratio of the cross sectional area of the breather outlet to the cross sectional area of the secondary outlet is approximately 0.15.

* * * * *

UNITED STATES PATENT AND TRADEMARK OFFICE

CERTIFICATE OF CORRECTION

PATENT NO. : 5,140,957

DATED : August 25, 1992

INVENTOR(S) : Robert A. Walker

It is certified that error appears in the above-identified patent and that said Letters Patent is hereby corrected as shown below:

Column 3, line 10, before "44" insert -- tube --.
Column 3, lines 37,39, change "dB" to -- db --.
Column 3, lines 39,40, the lines should read as follows: -- 113.5 db ). The combination apparatus may be constructed with or without the air-silencer installed with --.

Column 6, line 48, after "with" insert -- the --.

Column 9, line 1, after "apparatus" insert -- as --.

Column 12, line 7, before "39" insert -- claim --.

Signed and Sealed this

Twenty-first Day of December, 1993

*Attest:*

Bruce Lehman

BRUCE LEHMAN

*Attesting Officer*

*Commissioner of Patents and Trademarks*